US011236482B2

(12) United States Patent
Jeon et al.

(10) Patent No.: US 11,236,482 B2
(45) Date of Patent: Feb. 1, 2022

(54) ATTACHMENT COUPLING DEVICE FOR HEAVY INDUSTRIAL EQUIPMENT

(71) Applicant: EVERDIGM CORP., Chungcheongbuk-do (KR)

(72) Inventors: Seong Tae Jeon, Cheongju-si (KR); Jin Kook Kim, Daejeon (KR)

(73) Assignee: EVERDIGM CORP., Chungcheongbuk-do (KR)

( * ) Notice: Subject to any disclaimer, the term of this patent is extended or adjusted under 35 U.S.C. 154(b) by 446 days.

(21) Appl. No.: 16/361,247

(22) Filed: Mar. 22, 2019

(65) Prior Publication Data

US 2020/0040546 A1 Feb. 6, 2020

(30) Foreign Application Priority Data

Aug. 1, 2018 (KR) ..... 10-2018-0089888

(51) Int. Cl.
*E02F 3/36* (2006.01)

(52) U.S. Cl.
CPC ..... *E02F 3/3622* (2013.01); *E02F 3/3618* (2013.01); *E02F 3/3663* (2013.01)

(58) Field of Classification Search
None
See application file for complete search history.

(56) References Cited

U.S. PATENT DOCUMENTS 6,422,805 B1 * 7/2002 Miller ..... E02F 3/3618 37/468
8,112,914 B2 * 2/2012 Miller ..... E02F 3/3663 37/468

FOREIGN PATENT DOCUMENTS

KR 10-2009-0069564 A 7/2009
KR 20110005057 A * 1/2011

* cited by examiner

*Primary Examiner* — Michael S Lowe
(74) *Attorney, Agent, or Firm* — Revolution IP, PLLC

(57) ABSTRACT

An attachment coupling device for heavy industrial equipment, includes a coupler body coupled to operation links of the heavy industrial equipment, a fixed hook fixedly mounted to the coupler body, a movable hook rotatably coupled to the coupler body, an actuator connected to the movable hook and rotatably connected to the coupler, and a pin locking unit rotatable through operation of the actuator, to lock a first pin of the attachment coupled to the fixed hook and the movable hook, to which a second pin of the attachment is coupled. The pin locking unit includes a pivot body rotatably coupled to the coupler body and connected to the actuator, a hook support for locking the movable hook, a pin support for locking the first pin, and a locking elastic member for preventing the pivot body from excessively pivoting in a release direction thereof.

14 Claims, 7 Drawing Sheets

[FIG.1]
- Conventional Art -
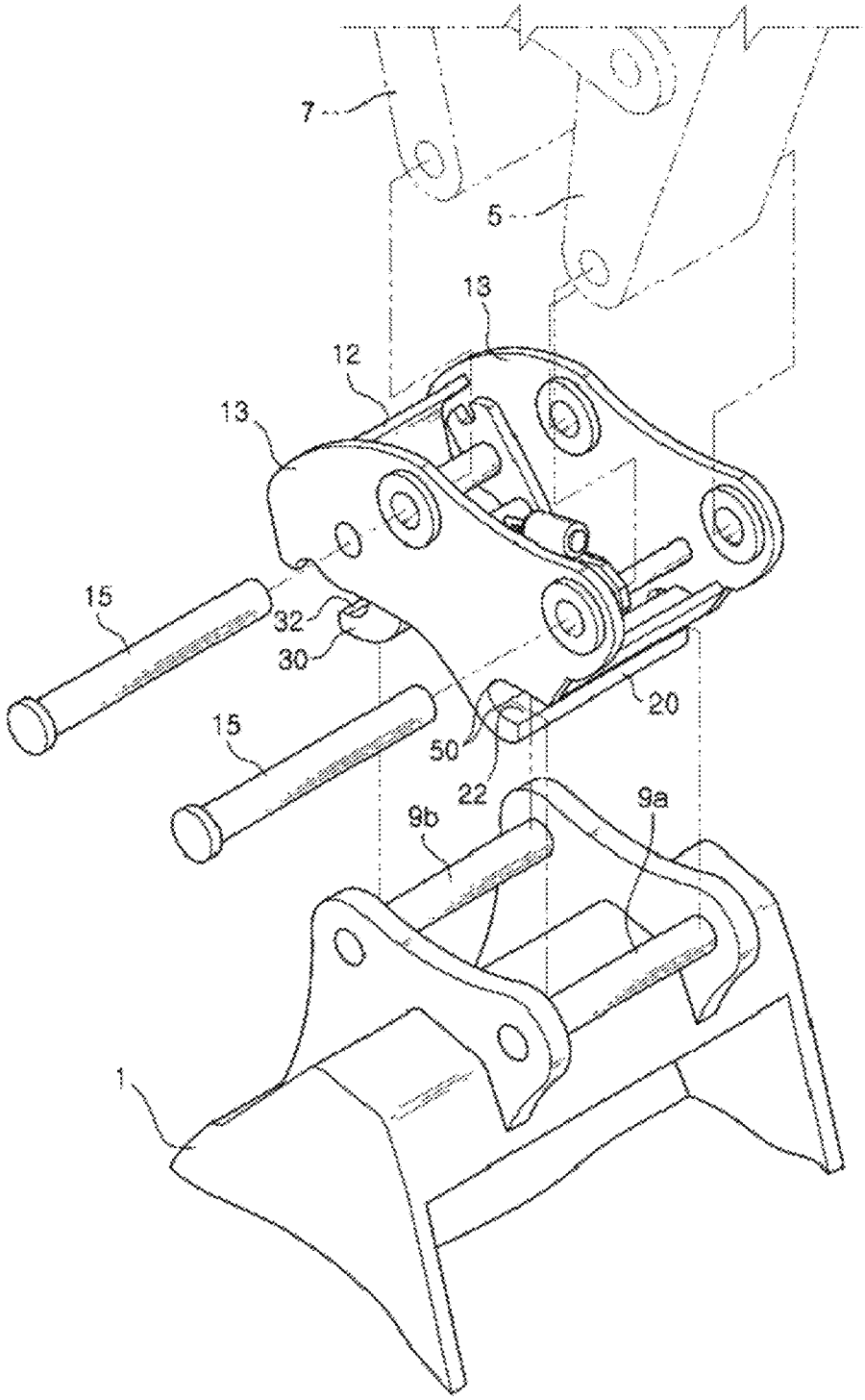

[FIG.2]
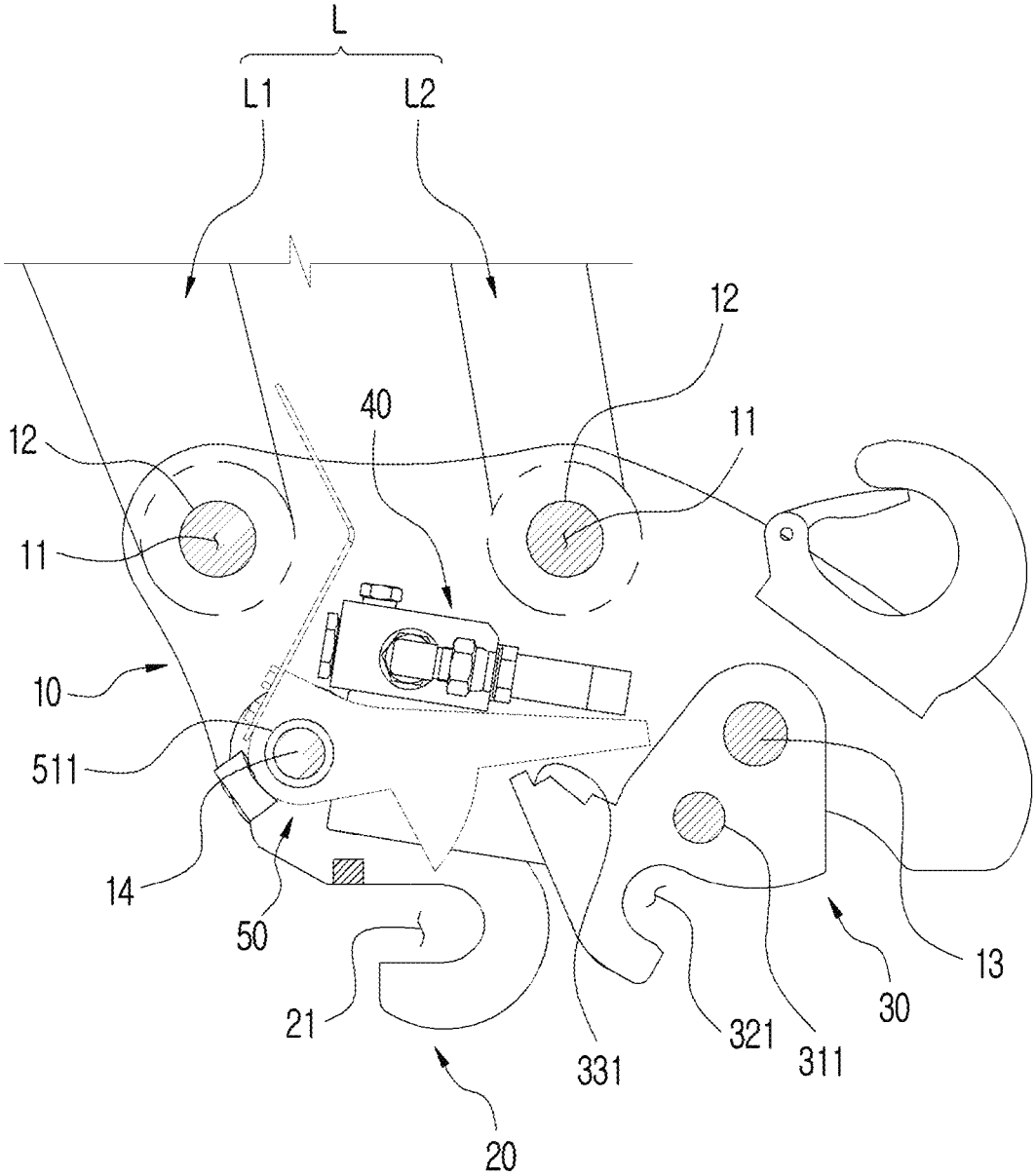

[FIG.3]
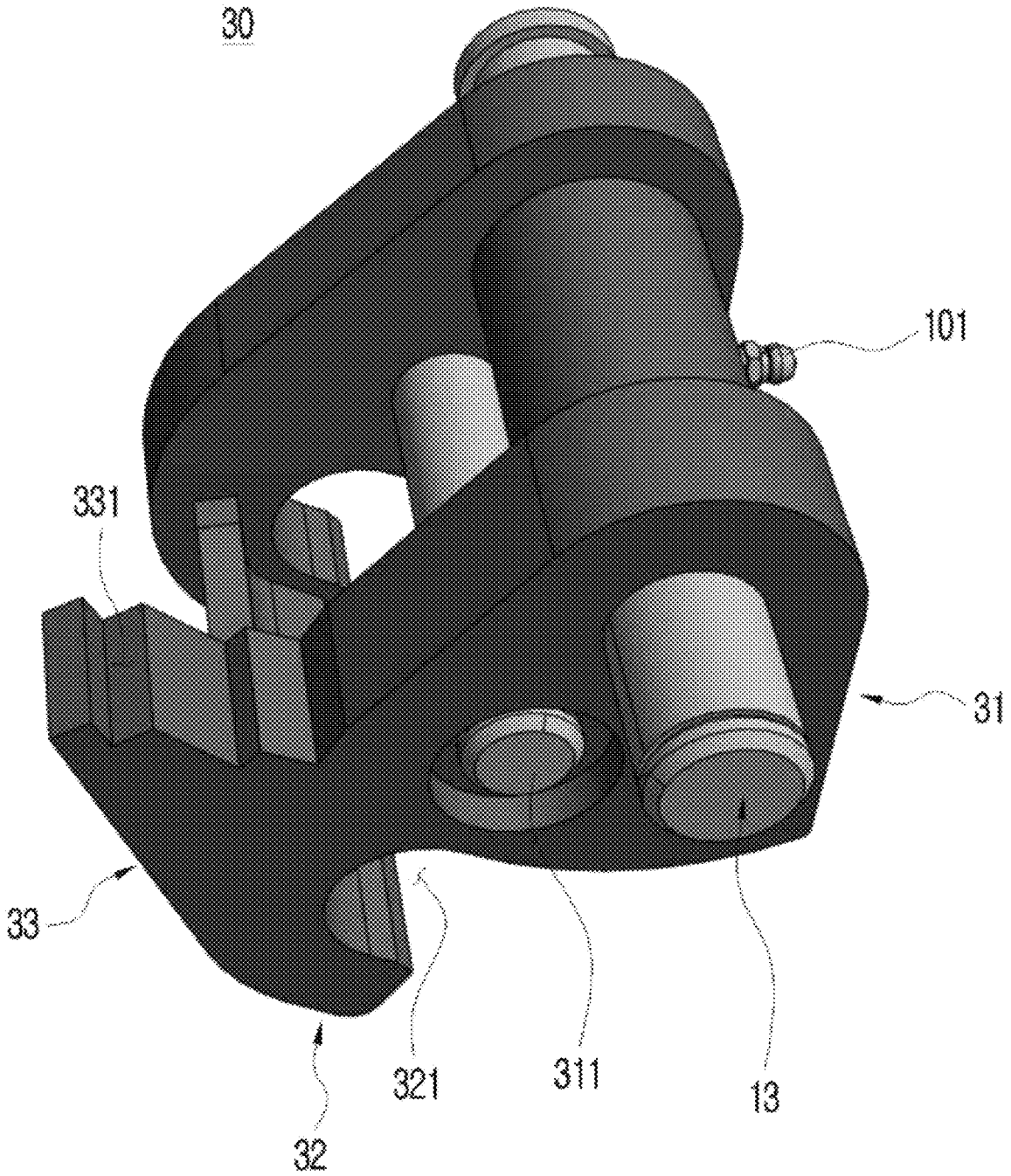

[FIG.4]
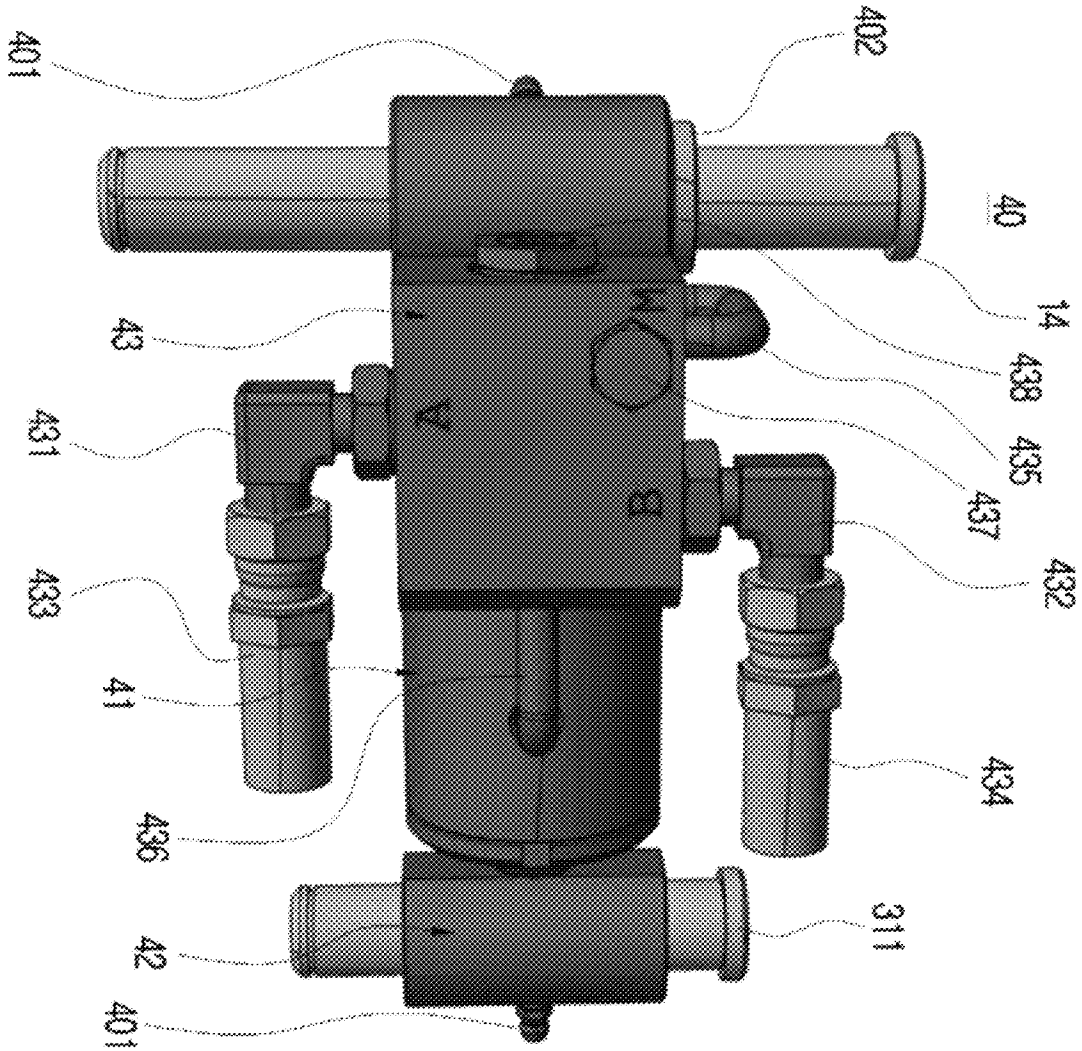

[FIG.5]
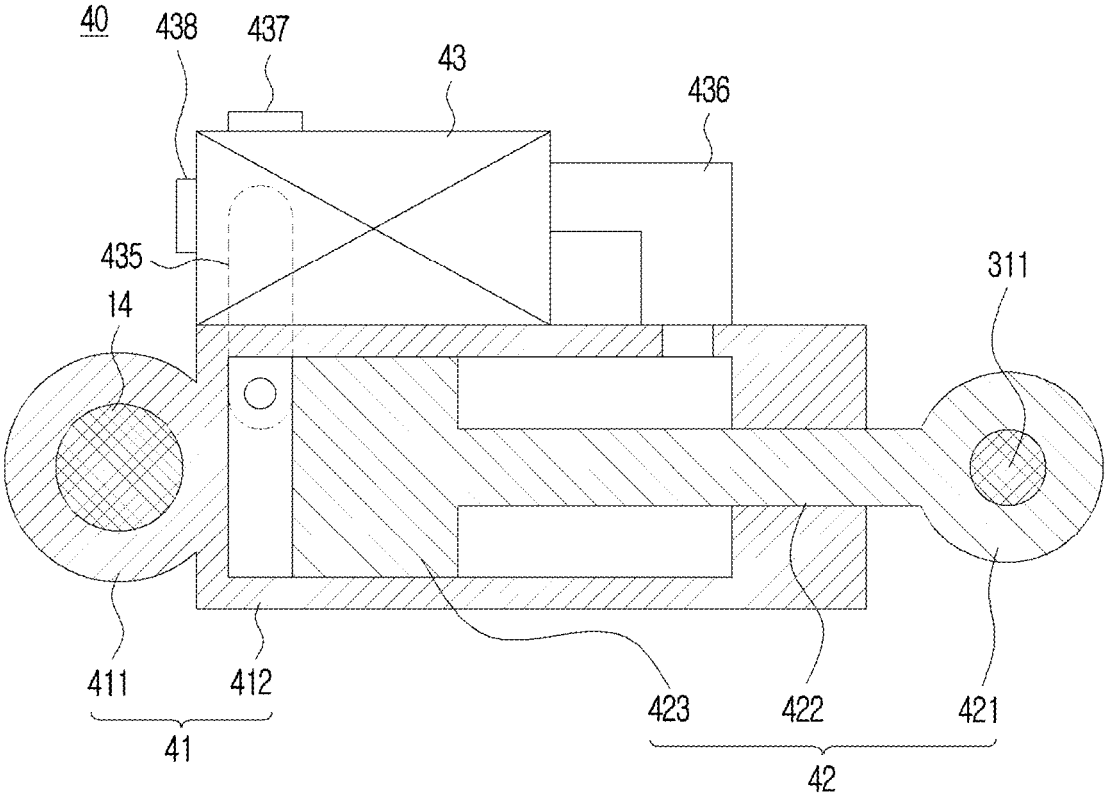

[FIG.6]
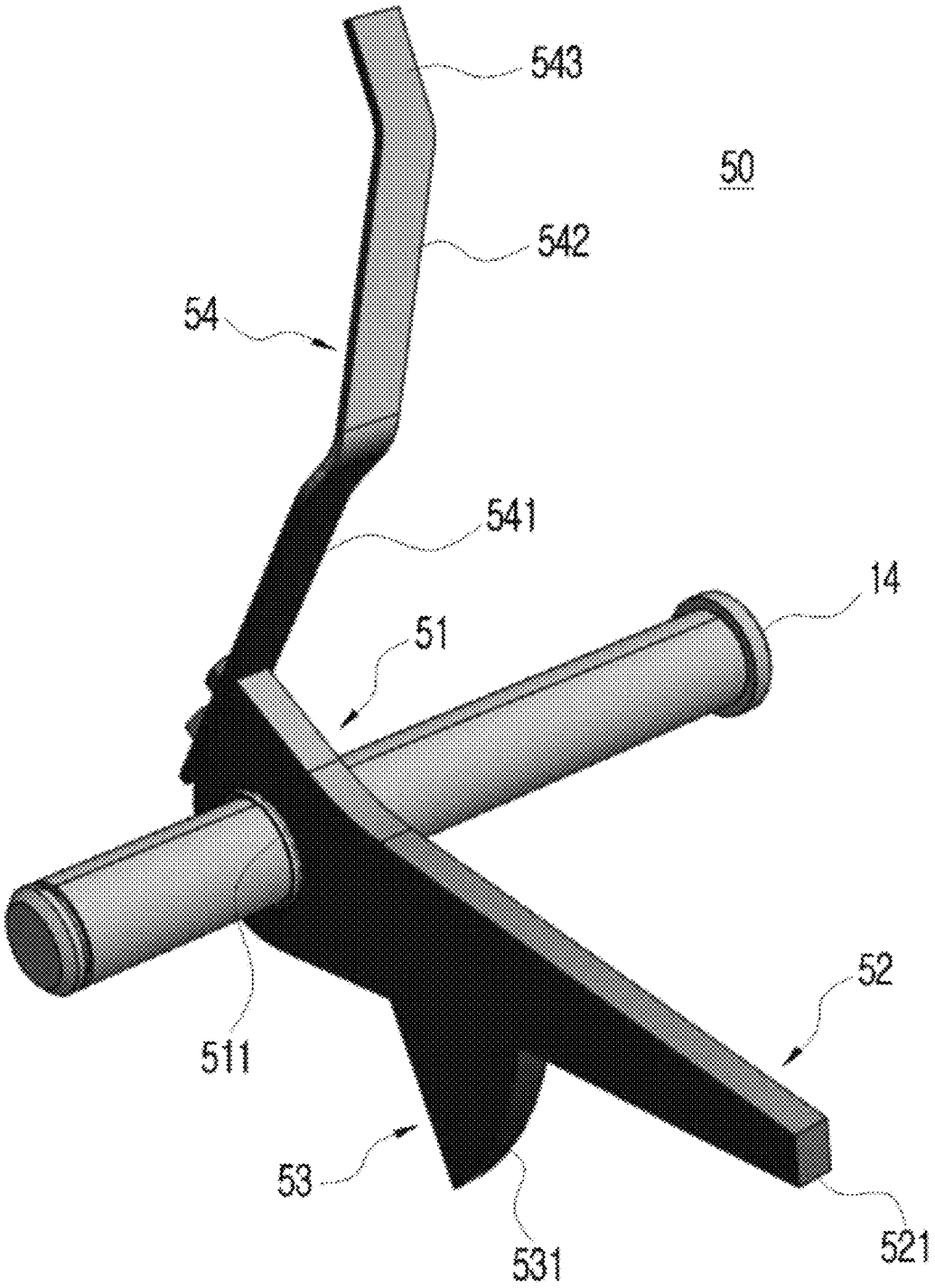

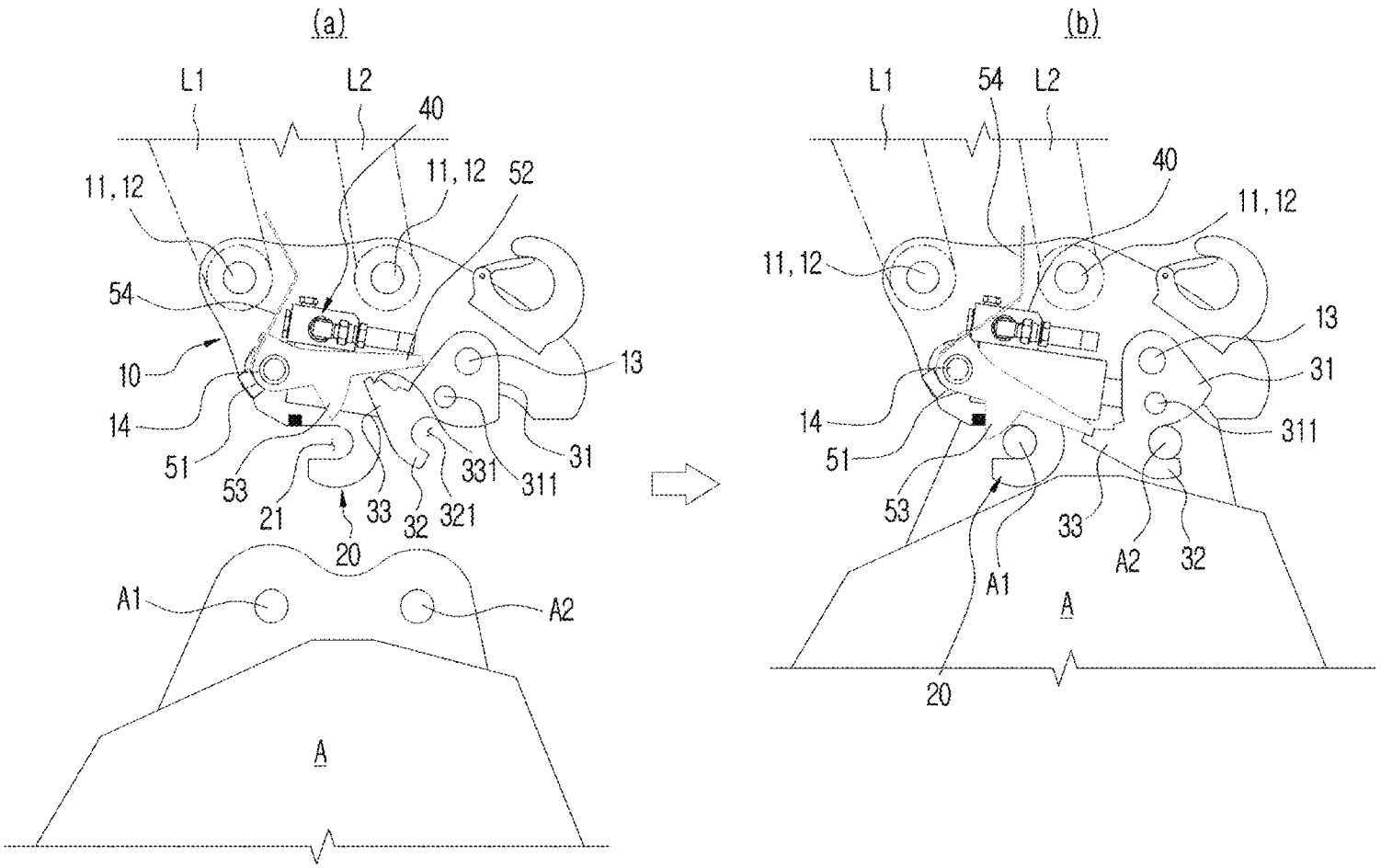
[FIG.7]

ATTACHMENT COUPLING DEVICE FOR HEAVY INDUSTRIAL EQUIPMENT

BACKGROUND OF THE INVENTION

Field of the Invention

The present invention relates to an attachment coupling device for heavy industrial equipment, and more particularly to an attachment coupling device for heavy industrial equipment, which is capable of ensuring perfect mounting of an attachment in heavy industrial equipment.

Description of the Related Art

Generally, heavy industrial equipment, such as an excavator, used in construction or civil engineering is configured to perform various tasks through replacement of several kinds of attachments in accordance with use purposes of the attachments, for example, digging using a bucket, building demolition and rebar cutting using a crusher, rock and concrete breaking tasks using a breaker, steel scrap and rubble transporting using a grabber, and the like. Meanwhile, such an attachment is separably mounted to operation links, for replacement thereof in accordance with use purposes thereof.

Referring to FIG. 1, a conventional attachment coupling device for heavy industrial equipment is shown. As shown in FIG. 1, the conventional attachment coupling device includes a body 12 configured to be coupled to operation links of the heavy industrial equipment, namely, a support link 5 and a drive link 7, by means of pins 15, a fixed hook 20 fixedly mounted to the body 12, to be engaged with a first coupling pin 9*a* of an attachment 1 in a hooking manner, and a movable hook 30 movably mounted to the body 12, to be engaged with a second coupling pin 9*b* of the attachment 1 in a hooking manner. Coupling grooves 22 and 32 are provided at the fixed hook 20 and the movable hook 30, to be coupled to first and second coupling pins 9*a* and 9*b* provided at the attachment 1, respectively.

When hydraulic fluid is supplied to a hydraulic cylinder installed in the body 12 in a state in which the first coupling pin 91 is coupled to the coupling groove 22 of the fixed hook 20 through movement of operation links, namely, the support link 5 and the drive link 7, a rod is extracted from the hydraulic cylinder such that the movable hook 30 is rotated to a coupling position and, as such, the second coupling pin 9*b* is coupled to the coupling groove 32 of the movable hook 30. Accordingly, the attachment 1 may be mounted to the attachment coupling device. On the other hand, when the hydraulic fluid is discharged from the hydraulic cylinder, the rod is retracted into the hydraulic cylinder such that the movable hook 30 is rotated to a release position and, as such, the second coupling pin 9*b* is separated from the coupling groove 32 of the movable hook 30. In this state, the attachment 1 may be separated from the attachment coupling device in accordance with separation of the first coupling pin 9*a* from the coupling groove 22 of the fixed hook 20 through movement of the operation links.

However, when the hydraulic fluid supplied to the hydraulic cylinder leaks or the rod of the hydraulic cylinder is broken, coupling between the movable hook 30 and the second coupling pin 9*b* is released and, as such, the attachment 1 may be unintentionally separated from the attachment coupling device. In this case, accidents may occur due to the separated attachment 1.

To this end, locking devices have been developed to lock the first and second coupling pins 9*a* and 9*b* respectively coupled to the fixed and movable hooks 20 and 30. However, such a locking device is complex in terms of structure and operation. Furthermore, when the locking device is damaged, there still may be the problem that the attachment 1 is unintentionally separated from the attachment coupling device, as in the above-mentioned conventional case.

As related art, there is a patent document: Korean Unexamined Patent Publication No. 2009-0069564 laid open on Jul. 1, 2009 and entitled "ATTACHMENT COUPLING DEVICE FOR HEAVY INDUSTRIAL EQUIPMENT".

SUMMARY OF THE INVENTION

Therefore, the present invention has been made in view of the above problems, and it is an object of the present invention to provide an attachment coupling device for heavy industrial equipment capable of preventing unintentional separation of an attachment therefrom when hydraulic fluid supplied to a hydraulic cylinder leaks or a rod of the hydraulic cylinder is broken and, as such, ensuring perfect mounting of the attachment.

In accordance with the present invention, the above and other objects can be accomplished by the provision of an attachment coupling device for heavy industrial equipment including a coupler body coupled to operation links of the heavy industrial equipment, a fixed hook fixedly mounted to the coupler body, to lock a first pin provided at the attachment, a movable hook spaced apart from the fixed hook, to lock a second pin provided at the attachment while being spaced apart from the first pin, the movable hook being rotatably coupled to the coupler body via a hook rotating shaft, an actuator connected, at one side thereof, to the movable hook via an actuator connecting pin while being rotatably connected, at the other side thereof, to the coupler body via a drive support shaft spaced apart from the hook rotating shaft such that the actuator is rotatable about the hook rotating shaft, and a pin locking unit coupled to the drive shaft such that the pin locking unit is rotatable about the drive support shaft in accordance with an operation of the actuator, to lock not only the first pin coupled to the fixed hook, but also the movable hook, to which the second pin is coupled.

The pin locking unit may include a pivot body rotatably coupled to the drive support shaft while being connected to the actuator, a hook support extending from one side of the pivot body in a normal direction of the drive support shaft, for locking of the movable hook, to which the second pin is coupled, a pin support extending from at least one of the pivot body and the hook support in a direction crossing the normal direction of the drive support shaft, for locking of the first pin coupled to the fixed hook, and a locking elastic member extending from the other side of the pivot body in a direction opposite to the extension direction of the pin support.

When the actuator operates to lock the second pin in a state in which the fixed hook is coupled to the first pin, the movable hook rotates about the hook rotating shaft such that the movable hook is coupled to the second pin, and the pin locking unit rotates about the drive support shaft, along with the actuator, such that the pin support comes into contact with the first pin coupled to the fixed hook, to cause the first pin to closely contact the fixed hook, and the hook support comes into contact with the movable hook coupled to the second pin, to cause the second pin to closely contact the movable hook.

The hook support may be provided with an engagement jaw. The movable hook may be provided with an engagement groove to be engaged with the engagement jaw.

The pin support may have an inclined support surface formed at a portion of the pin support facing the first pin coupled to the fixed hook, to press the first pin into a retaining groove provided at the fixed hook in accordance with rotation of the pivot body.

The locking elastic member may be elastically supported by a support link as one of the operation links when the hook support is pivotally moved to a release position by the movable hook in a retraction state of the actuator.

The movable hook may include a hook body rotatably coupled to the coupler body via the hook rotating shaft, and provided with the actuator connecting pin spaced apart from the hook rotating shaft such that the actuator is rotatably coupled to the actuator connecting pin, a hook portion extending from the hook body, to be coupled to the second pin, and a locking protrusion extending from one of the hook body and the hook portion such that the pin locking unit is positioned adjacent to the locking protrusion, comes into contact with the locking protrusion, or is pressed to closely contact the locking protrusion.

The actuator may include a cylinder rotatably coupled to the coupler body via the drive support shaft, a piston rotatably reciprocally movably coupled to the cylinder while being coupled to the movable hook by an actuator connecting pin spaced apart from the hook rotating shaft, and a hydraulic distribution unit for supplying hydraulic fluid to the cylinder, for reciprocation of the piston in the cylinder.

In the attachment coupling device for heavy industrial equipment according to the present invention, perfect mounting of the attachment in the heavy industrial equipment may be ensured. In particular, it may be possible to prevent the attachment from being unintentionally separated from the attachment coupling device when hydraulic fluid supplied to the actuator leaks, or the piston rod of the actuator is broken.

In addition, the operator of the heavy industrial equipment may easily identify the mounted state of the attachment by identifying an operation state of the pin locking unit according to operation of the actuator.

Furthermore, the locked state of the first pin in the fixed hook may be maintained by the pin support of the pin locking unit and, as such, it may be possible to prevent the attachment from being separated due to unexpected accidents occurring during execution of tasks.

The locked state of the second pin in the movable hook may also be maintained by the hook support of the pin locking unit and, as such, it may be possible to stably maintain the locked state of the attachment, that is, a perfectly mounted state of the attachment, in accordance with additional locking of the first pin and the second pin.

In addition, the coupling state between the movable hook and the second pin may be stably maintained by the locking elastic member.

Furthermore, the pivot body is elastically supported by the support link in accordance with the locking elastic member and, as such, excessive pivotal movement of the pivot body within the coupler body may be prevented. Accordingly, stable operation of the hook support and the movable hook may be ensured.

In particular, the detailed configuration of the locking elastic member may exhibit sufficient elastic force with reference to the support link.

In addition, the engagement jaw is stably seated in and supported by the engagement groove and, as such, the perfectly mounted state of the attachment may be stably maintained.

Furthermore, in accordance with the configuration of the movable hook, it may be possible to ensure reliable coupling between the movable hook and the second pin according to pivotal movement of the movable hook, and to ensure reliable coupling between the pin locking unit and the movable hook according to pivotal movement of the pin locking unit.

In addition, In accordance with the configuration of the locking protrusion, it may be possible to ensure reliable coupling relations between the pin locking unit and the movable hook while preventing the hook body from interfering with pivotal movement of the pin locking unit. The hook support of the pin locking unit may also stably lock the locking protrusion in accordance with pivotal movement of the pin locking unit.

Furthermore, it may be possible to stably grasp and retain the first pin and the second pin in accordance with configurations of the fixed hook and the movable hook, respectively.

In addition, in accordance with the configuration of the actuator, it may be possible to ensure reliable pivotal movement of the movable hook and reliable pivotal movement of the pin locking unit associated therewith. The locking elastic member may also exhibit stable elastic force.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view showing a conventional attachment coupling device for heavy industrial equipment;

FIG. 2 is a sectional view illustrating an attachment coupling device for heavy industrial equipment according to an embodiment of the present invention;

FIG. 3 is a perspective view illustrating a movable hook in the attachment coupling device according to the illustrated embodiment of the present invention;

FIG. 4 is a plan view illustrating an actuator in the attachment coupling device according to the illustrated embodiment of the present invention;

FIG. 5 is a cross-sectional view illustrating the actuator in the attachment coupling device according to the illustrated embodiment of the present invention;

FIG. 6 is a perspective view illustrating a pin locking unit as a double-locking means in the attachment coupling device according to the illustrated embodiment of the present invention; and FIG. 7 is a view illustrating operation states of the attachment coupling device according to the illustrated embodiment of the present invention.

DETAILED DESCRIPTION OF THE INVENTION

Reference will now be made in detail to the preferred embodiments of the present invention associated with an attachment coupling device for heavy industrial equipment, examples of which are illustrated in the accompanying drawings. Meanwhile, detailed description and illustration of functions and configurations well known in the art may be omitted from the following description and accompanying drawings to avoid obscuring appreciation of the present invention by a person of ordinary skill in the art.

Referring to FIGS. 2 to 7, an attachment coupling device for heavy industrial equipment according to an embodiment of the present invention, which may ensure perfect mounting of an attachment A to the heavy industrial equipment, is illustrated. The attachment coupling device is coupled to operation links L of the heavy industrial equipment. The attachment A is separably coupled to the attachment coupling device. When the operation links L operate in a state in which the attachment A is coupled to the operation links L by means of the attachment coupling device according to the illustrated embodiment of the present invention, it may be possible to pivotally move the attachment A or to shift the position of the attachment A.

Here, the operation links L may be divided into a support link L1 rotatably coupled to the attachment coupling device according to the illustrated embodiment of the present invention, and a drive link L2 rotatably coupled to the attachment coupling device while being spaced apart from the support link L1. The attachment coupling device rotates about the support link L1 in accordance with operation of the drive link L2 and, as such, may pivotally move the attachment A coupled thereto. In addition, when the entirety of the operation links L operates, it may be possible to shift the position of the attachment A coupled to the attachment coupling device.

The attachment A may be separably coupled to the attachment coupling device for heavy industrial equipment according to the illustrated embodiment of the present invention. The attachment A may be replaced with another attachment in accordance with tasks to be carried out by the heavy industrial equipment. As such, several kinds of attachments having different use purposes are prepared to enable the heavy industrial equipment to carry out various tasks through replacement of the attachments.

The attachment A may include a first pin A1, and a second pin A2 spaced apart from the first pin A1 while extending in parallel to the first pin A1, in order to couple the attachment A to the attachment coupling device according to the illustrated embodiment of the present invention.

The attachment coupling device for heavy industrial equipment according to the illustrated embodiment of the present invention may include a coupling body 10, a fixed hook 20, a movable hook 30, an actuator 40, and a pin locking unit 50.

The coupler body 10 is coupled to the operation links L of the heavy industrial equipment.

The coupler body 10 is provided with link coupling sections 11 for coupling the coupler body 10 to the operation links L. The link coupling sections 11 are provided in a pair and, as such, are spaced apart from each other. The link coupling sections 11 are coupled to the support link L1 and the drive link L2 by means of link coupling pins 12 provided in a pair, respectively. For example, one of the link coupling pins 12 may be fitted in the support link L1 at one of the link coupling sections 11, and the other of the link coupling pins 12 may be fitted in the drive link L2 at the other of the link coupling sections 11.

For example, the link coupling pins 12 may be fixedly mounted to the coupler body 10 by pin fixing means (not shown), and may be rotatably coupled to the operation links L, respectively. Of course, the link coupling pins 12 are not limited to the above-described conditions. For example, the link coupling pins 12 may be rotatably coupled to the coupler body 10, and may be fixedly mounted to the operation links L, respectively. A lubricant injector (not shown) may be provided at any one of the support link L1 and one link coupling pin 12, to inject a lubricant between the support link L1 and the link coupling pin 12. The lubricant injector (not shown) may supply a lubricant to frictional surfaces between each link coupling pin 12 and each operation link L and frictional surfaces between each link coupling pin 12 and the coupler body 10.

A hook rotating shaft 13 may be provided at the coupler body 10, for rotational coupling of the movable hook 30. The hook rotating shaft 13 is spaced apart from the link coupling sections 11. For example, the hook rotating shaft 13 may be fixedly mounted to the coupler body 10, and may be rotatably coupled to the movable hook 30. Of course, the hook rotating shaft 13 is not limited to the above-described conditions. For example, the hook rotating shaft 13 may be rotatably coupled to the coupler body 10, and the movable hook 30 may be fixedly mounted to the hook rotating shaft 13. The hook rotating shaft 13 is fitted in both the coupler body 10 and the movable hook 30. In this case, a shaft lubrication member 101 may be provided at one of the hook rotating shaft 13 and the movable hook 30 in order to inject a lubricant between the hook rotating shaft 13 and the movable hook 30. The shaft lubrication member 101 may supply a lubricant to frictional surfaces between the hook rotating shaft 13 and the movable hook 30 and frictional surfaces between the hooking rotating shaft 13 and the coupler body 10.

A drive support shaft 14 may be provided at the coupler body 10 in order to rotatably couple the actuator 40 and the pin locking unit 50. The drive support shaft 14 is spaced apart from the link coupling sections 11 and the hook rotating shaft 13. For example, the drive support shaft 14 may be fixedly mounted to the coupler body 10, and may be rotatably coupled to the actuator 40 and the pin locking unit 50. Of course, the drive support shaft 14 is not limited to the above-described conditions. For example, the drive support shaft 14 may be rotatably coupled to the coupler body 10, and the actuator 40 and the pin locking unit 50 may be fixedly mounted to the drive support shaft 14. The drive support shaft 14 is fitted in the coupler body 10, the actuator 40, and the pin locking unit 50. In this case, an operation lubrication member 401 may be provided at one of the drive support shaft 14 and the actuator 40 in order to inject a lubricant between the drive support shaft 14 and the actuator 40. The operation lubrication member 401 may supply a lubricant to frictional surfaces between the drive support shaft 14 and the actuator 40, frictional surfaces between the drive support shaft 14 and the pin locking unit 50, and frictional surfaces between the drive support shaft 14 and the coupler body 10.

The fixed hook 20 is fixedly mounted to the coupler body 10 in order to lock the first pin A1 provided at the attachment A. The fixed hook 20 is spaced apart from the link coupling sections 11, the hook rotating shaft 13 and the drive support shaft 14 while protruding from the coupler body 10. A retraining groove 21 is formed at the fixed hook 20. The first pin A1 is inserted into the retaining groove 21, to be supported by the fixed hook 20.

The movable hook 30 is spaced apart from the fixed hook 20 in order to lock the second pin A2 provided at the attachment A while being spaced apart from the first pin A1. The movable hook 30 may be spaced apart from the link coupling sections 11 and the fixed hook 20. The movable hook 30 is rotatably coupled to the coupler body 10 by means of the hook rotating shaft 13.

The movable hook 30 may include a hook body 31, a hook portion 32, and a locking protrusion 33.

The hook body 31 is rotatably coupled to the coupler body 10 by means of the hook rotating shaft 13. The hook body 31 may be provided with an actuator connecting pin 311 spaced apart from the hook rotating shaft 13 in order to rotatably couple the actuator 40 to the hook body 31. The actuator connecting pin 311 is fixedly mounted to the hook body 31, and the actuator 40 may be rotatably coupled to the actuator connecting pin 311. Alternatively, the actuator connecting pin 311 may be fixedly mounted to the actuator 40, and may be rotatably mounted to the hook body 31.

The hook portion 32 extends from the hook body 31, for coupling thereof to the second pin A2. The hook portion 32 is formed with a retaining groove 321, into which the second pin A2 is inserted, to be supported by the hook portion 32.

The locking protrusion 33 extends from one of the hook body 31 and the hook portion 32 such that the pin locking unit 50 may be positioned adjacent to the locking protrusion 33, may come into contact with the locking protrusion 33, or may be pressed to closely contact the locking protrusion 33. The locking protrusion 33 may be provided with an engagement groove 331. A engagement jaw 521 provided at a hook support member 52 in the pin locking unit 50 may be coupled to the engagement groove 331 in an engagement or fitting manner.

The actuator 40 is rotatably coupled to the coupler body 10 by means of the drive support shaft 14 spaced apart from the hook rotating shaft 13, in order to rotate the movable hook 30 about the hook rotating shaft 13.

The actuator 40 may operate in a cylinder operation manner in which a rod centrally installed in a cylinder is extracted or retracted in accordance with supply or discharge of hydraulic fluid. The actuator 40 may include a cylinder 41, a piston 42, and a hydraulic pressure distribution unit 43.

The cylinder 41 is rotatably coupled to the coupler body 10 by means of the drive support shaft 14. The cylinder 41 may include a body support boss 411 rotatably coupled to the drive support shaft 14, and a cylinder body 412 extending from the body support boss 411, to guide reciprocation of the piston 42. The drive support shaft 14 may be fitted in the body support boss 411. An operation lubrication member 401 may be provided at the body support boss 411, to supply a lubricant to frictional surfaces between the drive support shaft 14 and the body support boss 411. The cylinder body 412 may have a hollow cylindrical structure defining a passage through which the piston 423 reciprocates.

The piston 42 is rotatably coupled to the movable hook 30 by means of an actuator connecting pin 31 spaced apart from the hook rotating shaft 13. The piston 42 is also reciprocally movably coupled to the cylinder 41. The piston 42 may include a rod support boss 421 rotatably coupled to the actuator connecting pin 311, a piston rod 422 coupled to the cylinder body 412 of the cylinder 41 such that the piston rod 422 is reciprocally movable in a longitudinal direction of the cylinder body 412, and a piston 423 provided at an end of the piston rod 422, to reciprocate in the cylinder body 412. The actuator connecting pin 311 may be fitted in the rod support boss 421. An operation lubrication member 401 may be provided at the rod support boss 421, to supply a lubricant to frictional surfaces between the actuator connecting pin 311 and the rod support boss 421.

The hydraulic distribution unit 43 supplies hydraulic fluid to the cylinder 41, for reciprocation of the piston 42 in the cylinder 41. The hydraulic distribution unit 43 may include a first inlet/outlet 431 to which hydraulic fluid for extraction of the actuator 40 is supplied, and a second inlet/outlet 432 to which hydraulic fluid for retraction of the actuator 40 is supplied. The hydraulic distribution unit 43 may further include a first supply/discharge line 433 connected to the first inlet/outlet 432 and adapted to form a fluid supply/discharge path, and a second supply/discharge line 434 connected to the second inlet/outlet 432 and adapted to form a fluid supply/discharge path. In addition, the hydraulic distribution unit 43 may include a first reciprocation line 435 connected to one side of the cylinder 41 and adapted to form a fluid supply/discharge path for extraction of the actuator 40, and a second reciprocation line 436 connected to the other side of the cylinder 41 and adapted to form a fluid supply/discharge path for retraction of the actuator 40. Here, extraction of the actuator 40 means that the piston 42 of the cylinder 41 protrudes as hydraulic fluid is supplied to an extraction portion of the actuator 40, or hydraulic fluid is discharged from a retraction portion of the actuator 40. Retraction of the actuator 40 means that the piston 42 is withdrawn into the cylinder 41 as hydraulic fluid is discharged from the extraction portion of the actuator 40, or hydraulic fluid is supplied to the retraction portion of the actuator 40.

Accordingly, extraction of the actuator 40 or retraction of the actuator 40 may be achieved by the hydraulic fluid supplied to the first supply/discharge line 433 or the hydraulic fluid supplied to the second supply/discharge line 434.

For example, when hydraulic fluid is supplied to the first supply/discharge line 433, the hydraulic fluid is fed to one side of the cylinder 41 via the first inlet/outlet 431, the hydraulic distribution unit 43, and the first reciprocation line 435. As a result, the hydraulic fluid presses the piston 423, thereby causing the piston rod 422 of the piston 42 to protrude from the cylinder body 412 of the cylinder 41. Thus, extraction of the actuator 40 is achieved. In this case, hydraulic fluid present in the other side of the cylinder 41 is discharged through the second reciprocation line 436, the hydraulic distribution unit 43, the second inlet/outlet 432 and the second supply/discharge line 434, and, as such, may be recovered at the outside.

In another example, when hydraulic fluid is supplied to the second supply/discharge line 434, the hydraulic fluid is fed to the other side of the cylinder 41 via the second inlet/outlet 432, the hydraulic distribution unit 43, and the second reciprocation line 436. As a result, the hydraulic fluid presses the piston 423, thereby causing the piston rod 422 of the piston 42 to be withdrawn into the cylinder body 412 of the cylinder 41. Thus, retraction of the actuator 40 is achieved. In this case, hydraulic fluid present in one side of the cylinder 41 is discharged through the first reciprocation line 435, the hydraulic distribution unit 43, the first inlet/outlet 431 and the first supply/discharge line 433, and, as such, may be recovered at the outside.

The pin locking unit 50 is coupled to the drive support shaft 14 in order to lock not only the first pin A1 coupled to the fixed hook 20, but also the movable hook 30 to which the second pin A2 is coupled. The pin locking unit 50 is connected to the actuator 40 in order to rotate about the drive support shaft 14, along with the actuator 40, in accordance with operation of the actuator 40. When the actuator 40 operates, the pin locking unit 50 rotates about the drive support shaft 14 in accordance with the operation of the actuator 40.

The pin locking unit 50 may include a pivot body 51, a hook support 52, and a pin support 53. The pin locking unit 50 may further include a locking elastic member 54.

The pivot body 51 is rotatably coupled to the drive support shaft 14, along with the actuator 40. In detail, the pivot body 51 is rotatably coupled to the drive support shaft 14 via a connecting bush 511. Accordingly, the pivot body 51 may independently rotate about the drive support shaft 14, irrespective of operation of the actuator 40.

The hook support 52 extends from one side of the pivot body 51 in a normal direction of the drive support shaft 14, for locking of the movable hook 30 to which the second pin A2 is coupled. The hook support 52 may be provided with an engagement jaw 521 to be seated in the engagement groove 331 of the movable hook 30, for engaged or fitted coupling thereof with the engagement groove 331.

The pin support 53 extends from at least one of the pivot body 51 and the hook support 52 in a direction crossing the normal direction of the drive support shaft 14, for locking of the first pin A1 coupled to the fixed hook 20. The pin support 53 functions to press the first pin A1 toward the inside of the retaining groove 21 of the fixed hook 20 in accordance with rotation of the pivot body 51 caused by gravity. An inclined support surface 531 may be formed at a portion of the pin support 53 facing the first pin A1 coupled to the fixed hook 20.

The locking elastic member 54 extends from the other side of the pivot body 51 in a direction opposite to the extension direction of the pin support 53. The locking elastic member 54 has elasticity, and may be elastically deformed by external force.

The locking elastic member 54 may include an elastic rod portion 541 coupled to the other side of the pivot body 51, an elastic extension portion 542 extending inclinedly from the elastic rod portion 541, and an elastic grasping portion 543 extending from the elastic extension portion 542 to the outside of the coupler body 10.

The locking elastic member 54 may form a free end or may be elastically supported by the support link L1 in an initial state thereof. When the hook support 52 pivotally moves to a release position by the movable hook 30 in a retraction state of the actuator 40, the locking elastic member 54 is elastically supported by the support link L1, thereby preventing the pivot body 51 from excessively pivotally moving in a release direction of the pivot body 51. As such, the locking elastic member 54 functions to achieve stable operation of the pivot body 51 within the coupler body 10.

In addition, the operator of the heavy industrial equipment may identify, with the naked eye, a mounted state of the attachment A in accordance with a position of the pin support 53 protruded from the coupler body 10. In connection with this, the pin locking unit 50 may have a color distinguished from that of the coupler body 10, the movable hook 30 or the actuator 40, for easy identification thereof.

Hereinafter, operation of the attachment coupling device according to the embodiment of the present invention illustrated in FIG. 7 will be described.

When one operation link L of the heavy industrial equipment, for example, the drive link L2 or the support link L1, operates, the first pin A1 is inserted into and supported by the retaining groove 21 of the fixed hook 20 and, as such, the fixed hook 20 is coupled to the first pin A1.

When the actuator 40 operates for locking of the second pin A2 in this state, the piston rod 422 of the actuator 40 is extracted, thereby causing the movable hook 30 to rotate about the hook rotating shaft 13 in a normal direction. As a result, the second pin A2 is inserted into and supported by the retaining groove 321 of the movable hook 30 and, as such, the movable hook 30 is coupled to the second pin A2. In this case, the drive link L2 may operate along with the actuator 40.

In this case, the pin locking unit 50 rotates about the drive support shaft 14 in the normal direction, along with the actuator 40 and, as such, the pin support 53 comes into contact with the first pin A1 coupled to the fixed hook 20, thereby causing the first pin A1 to closely contact an inner surface of the retaining groove 21 of the fixed hook 20. Accordingly, the first pin A1 is maintained in a locked state. Meanwhile, the hook support 52 moves pivotally by gravity without interfering with rotation of the movable hook 30. In accordance with pivotal movement of the hook support 52, the engagement jaw 521 comes into contact with the engagement groove 331 of the movable hook 30, to which the second pin A2 is coupled, thereby causing the second pin A2 to closely contact an inner surface of the retaining groove 321 in the movable hook 30. Accordingly, the movable hook 30 is maintained in a locked state.

Consequently, the attachment coupling device according to the illustrated embodiment of the present invention may achieve a primary locking state in which the first pin A1 is coupled to the fixed hook 20, and the second pin A2 is coupled to the movable hook 30. At the same time, the attachment coupling device may achieve a secondary locking state in which, in accordance with rotation of the pin locking unit 50 along with the actuator 40, the pin support 53 locks the first pin A1 inserted into and supported by the retaining groove 21 of the fixed hook 20, thereby preventing the first pin A1 from being separated from the retaining groove 21, and the hook support 52 locks the movable hook 30, to which the second pin A2 is coupled, thereby preventing reverse rotation of the movable hook 30.

Accordingly, it may be possible to achieve a perfectly mounted state of the attachment A intended in the illustrated embodiment of the present invention.

On the contrary, when it is desired to release the perfectly mounted state of the attachment A intended in the illustrated embodiment of the present invention, the piston rod 422 of the actuator 40 moves in a retraction direction in order to release the locked state of the second pin A2, thereby achieving retraction of the actuator 40. In this case, the pin locking unit 50 rotates about the drive support shaft 14 in a reverse direction, along with the actuator 40, and, as such, engaged or fitted coupling of the hook support 52 in the movable hook 30 is released. As a result, locking between the hook support 52 and the movable hook 30 is released. At the same time, the movable hook 30 rotates about the hook rotating shaft 13 in the reverse direction and, as such, coupling between the movable hook 30 and the second pin A2 is released. As the piston rod 422 of the actuator 40 moves in the retraction direction, and the actuator 40 is retracted, the movable hook 30 operatively connected to the actuator 40 rotates about the hook rotating shaft 13 in the reverse direction, thereby releasing coupling between the movable hook 30 and the second pin A2, as described above. At the same time, in accordance with the reverse rotation of the movable hook 30, the engagement jaw 521 of the hook support 52 contacting the engagement groove 331 of the movable hook 30 moves away from the engagement groove 331 to a contact release position. In accordance with reverse rotation force of the movable hook 30, the locking protrusion 33 also rotates the hook support 52 in the reverse direction and, as such, the pin locking unit 50 rotates about the drive support shaft 14 in the reverse direction, along with the actuator 40, thereby releasing locking between the hook support 52 and the movable hook 30.

As the hook support 52 rotates continuously in the reverse direction in accordance with the reverse rotation force of the movable hook 30, locking between the pin support 53 operatively connected to the hook support 52 and the first pin A1 is also released.

In this case, the free end of the locking elastic member 54 contacts the support link L1, thereby elastically supporting the support link L1, and, as such, the locking elastic member 54 may prevent the hook support 52 from excessively pivotally moving in the reverse direction due to the reverse rotation force of the movable hook 30, and may function to achieve stable operation of the pivot body 51 within the coupler body 10.

Finally, when the support link L1 operates, coupling of the first pin A1 to the fixed hook 20 is released. Accordingly, the attachment A may be safely separated from the attachment coupling device according to the illustrated embodiment of the present invention.

In accordance with the above-described attachment coupling device for heavy industrial equipment, perfect mounting of the attachment A in the heavy industrial equipment may be ensured. In particular, it may be possible to prevent the attachment A from being unintentionally separated from the attachment coupling device when hydraulic fluid supplied to the actuator 40 leaks, or the piston rod 422 of the actuator 40 is broken.

In addition, the operator of the heavy industrial equipment may easily identify the mounted state of the attachment A by identifying an operation state of the pin locking unit 50 according to operation of the actuator 40.

Furthermore, the locked state of the first pin A1 in the fixed hook 20 may be maintained by the pin support 53 of the pin locking unit 50 and, as such, it may be possible to prevent the attachment A from being separated due to unexpected accidents occurring during execution of tasks.

The locked state of the second pin A2 in the movable hook 30 may also be maintained by the hook support 52 of the pin locking unit 50 and, as such, it may be possible to stably maintain the locked state of the attachment A, that is, a perfectly mounted state of the attachment A, in accordance with additional locking of the first pin A1 and the second pin A2.

In addition, the coupling state between the movable hook 30 and the second pin A2 may be stably maintained by the locking elastic member 54.

Furthermore, the pivot body 51 is elastically supported by the support link L1 in accordance with the locking elastic member 54 and, as such, excessive pivotal movement of the pivot body 51 within the coupler body 10 may be prevented. Accordingly, stable operation of the hook support 52 and the movable hook 30 may be ensured.

In particular, the detailed configuration of the locking elastic member 54 may exhibit sufficient elastic force with reference to the support link L1.

In addition, the engagement jaw 521 is stably seated in and supported by the engagement groove 331 and, as such, the perfectly mounted state of the attachment A may be stably maintained.

Furthermore, in accordance with the configuration of the movable hook 30, it may be possible to ensure reliable coupling between the movable hook 30 and the second pin A2 according to pivotal movement of the movable hook 30, and to ensure reliable coupling between the pin locking unit 50 and the movable hook 30 according to pivotal movement of the pin locking unit 50.

In addition, In accordance with the configuration of the locking protrusion 33, it may be possible to ensure reliable coupling relations between the pin locking unit 50 and the movable hook 30 while preventing the hook body 31 from interfering with pivotal movement of the pin locking unit 50. The hook support 52 of the pin locking unit 50 may also stably lock the locking protrusion 33 in accordance with pivotal movement of the pin locking unit 50.

Furthermore, it may be possible to stably grasp and retain the first pin A1 and the second pin A2 in accordance with configurations of the fixed hook 20 and the movable hook 30, respectively.

In addition, in accordance with the configuration of the actuator 40, it may be possible to ensure reliable pivotal movement of the movable hook 30 and reliable pivotal movement of the pin locking unit 50 associated therewith. The locking elastic member 54 may also exhibit stable elastic force.

Reference numeral "402" designates a support spacer for supporting the body support boss 411 around the drive support shaft 14. Reference numeral "437" designates a hydraulic plug for maintenance of inner hydraulic lines, and reference numeral "438" designates a hydraulic pressure check valve for anti-leakage of hydraulic fluid.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An attachment coupling device for heavy industrial equipment comprising:

a coupler body coupled to operation links of the heavy industrial equipment;

a fixed hook fixedly mounted to the coupler body, to lock a first pin provided at an attachment;

a movable hook spaced apart from the fixed hook, to lock a second pin provided at the attachment while being spaced apart from the first pin, the movable hook being rotatably coupled to the coupler body via a hook rotating shaft;

an actuator connected, at one side thereof, to the movable hook via an actuator connecting pin while being rotatably connected, at the other side thereof, to the coupler body via a drive support shaft spaced apart from the hook rotating shaft such that the actuator is rotatable about the hook rotating shaft; and a pin locking unit coupled to the drive support shaft such that the pin locking unit is rotatable about the drive support shaft in accordance with an operation of the actuator, to lock not only the first pin coupled to the fixed hook, but also the movable hook, to which the second pin is coupled, wherein the pin locking unit comprises a pivot body rotatably coupled to the drive support shaft while being connected to the actuator, a hook support extending from one side of the pivot body in a normal direction of the drive support shaft, for locking of the movable hook, to which the second pin is coupled, a pin support extending from at least one of the pivot body and the hook support in a direction crossing the normal direction of the drive support shaft, for locking of the first pin coupled to the fixed hook, and a locking elastic member extending from the other side of the pivot body in a direction opposite to the extension direction of the pin support, wherein the pin support has an inclined support surface formed at a portion of the pin support facing the first pin coupled to the fixed hook, to press the first pin into a retaining groove provided at the fixed hook in accordance with rotation of the pivot body, wherein the inclined support surface is formed with a protruding surface in a direction in which the first pin is constrained so that the first pin is constrained by being in close contact with an inner surface of the retaining groove.

2. The attachment coupling device according to claim 1, wherein:

when the actuator operates to lock the second pin in a state in which the fixed hook is coupled to the first pin, the movable hook rotates about the hook rotating shaft such that the movable hook is coupled to the second pin; and when the actuator operates to lock the second pin in a state in which the fixed hook is coupled to the first pin, the pin locking unit rotates about the drive support shaft, along with the actuator, such that the pin support comes into contact with the first pin coupled to the fixed hook, to cause the first pin to closely contact the fixed hook, and the hook support comes into contact with the movable hook coupled to the second pin, to cause the second pin to closely contact the movable hook.

3. The attachment coupling device according to claim 2, wherein the movable hook comprises:

a hook body rotatably coupled to the coupler body via the hook rotating shaft, and provided with the actuator connecting pin spaced apart from the hook rotating shaft such that the actuator is rotatably coupled to the actuator connecting pin;

a hook portion extending from the hook body, to be coupled to the second pin; and a locking protrusion extending from one of the hook body and the hook portion such that the pin locking unit is positioned adjacent to the locking protrusion, comes into contact with the locking protrusion, or is pressed to closely contact the locking protrusion.

4. The attachment coupling device according to claim 2, wherein the actuator comprises:

a cylinder rotatably coupled to the coupler body via the drive support shaft;

a piston rotatably reciprocally movably coupled to the cylinder while being coupled to the movable hook by an actuator connecting pin spaced apart from the hook rotating shaft; and a hydraulic distribution unit for supplying hydraulic fluid to the cylinder, for reciprocation of the piston in the cylinder.

5. The attachment coupling device according to claim 1, wherein:

the hook support is provided with an engagement jaw; and the movable hook is provided with an engagement groove to be engaged with the engagement jaw.

6. The attachment coupling device according to claim 5, wherein the movable hook comprises:

a hook body rotatably coupled to the coupler body via the hook rotating shaft, and provided with the actuator connecting pin spaced apart from the hook rotating shaft such that the actuator is rotatably coupled to the actuator connecting pin;

a hook portion extending from the hook body, to be coupled to the second pin; and a locking protrusion extending from one of the hook body and the hook portion such that the pin locking unit is positioned adjacent to the locking protrusion, comes into contact with the locking protrusion, or is pressed to closely contact the locking protrusion.

7. The attachment coupling device according to claim 5, wherein the actuator comprises:

a cylinder rotatably coupled to the coupler body via the drive support shaft;

a piston rotatably reciprocally movably coupled to the cylinder while being coupled to the movable hook by an actuator connecting pin spaced apart from the hook rotating shaft; and a hydraulic distribution unit for supplying hydraulic fluid to the cylinder, for reciprocation of the piston in the cylinder.

8. The attachment coupling device according to claim 1, wherein the locking elastic member is formed to extend from the other side of the pivot body in the direction opposite to the extension direction of the pin support such that the locking elastic member is elastically supported by a support link as one of the operation links when the hook support is pivotally moved to a release position by the movable hook in a retraction state of the actuator.

9. The attachment coupling device according to claim 8, wherein the movable hook comprises:

a hook body rotatably coupled to the coupler body via the hook rotating shaft, and provided with the actuator connecting pin spaced apart from the hook rotating shaft such that the actuator is rotatably coupled to the actuator connecting pin;

a hook portion extending from the hook body, to be coupled to the second pin; and a locking protrusion extending from one of the hook body and the hook portion such that the pin locking unit is positioned adjacent to the locking protrusion, comes into contact with the locking protrusion, or is pressed to closely contact the locking protrusion.

10. The attachment coupling device according to claim 8, wherein the actuator comprises:

a cylinder rotatably coupled to the coupler body via the drive support shaft;

a piston rotatably reciprocally movably coupled to the cylinder while being coupled to the movable hook by an actuator connecting pin spaced apart from the hook rotating shaft; and a hydraulic distribution unit for supplying hydraulic fluid to the cylinder, for reciprocation of the piston in the cylinder.

11. The attachment coupling device according to claim 1, wherein the movable hook comprises:

a hook body rotatably coupled to the coupler body via the hook rotating shaft, and provided with the actuator connecting pin spaced apart from the hook rotating shaft such that the actuator is rotatably coupled to the actuator connecting pin;

a hook portion extending from the hook body, to be coupled to the second pin; and a locking protrusion extending from one of the hook body and the hook portion such that the pin locking unit is positioned adjacent to the locking protrusion, comes into contact with the locking protrusion, or is pressed to closely contact the locking protrusion.

12. The attachment coupling device according to claim 1, wherein the movable hook comprises:

a hook body rotatably coupled to the coupler body via the hook rotating shaft, and provided with the actuator connecting pin spaced apart from the hook rotating shaft such that the actuator is rotatably coupled to the actuator connecting pin;

a hook portion extending from the hook body, to be coupled to the second pin; and a locking protrusion extending from one of the hook body and the hook portion such that the pin locking unit is positioned adjacent to the locking protrusion, comes into contact with the locking protrusion, or is pressed to closely contact the locking protrusion.

13. The attachment coupling device according to claim 1, wherein the actuator comprises:

a cylinder rotatably coupled to the coupler body via the drive support shaft;

a piston rotatably reciprocally movably coupled to the cylinder while being coupled to the movable hook by an actuator connecting pin spaced apart from the hook rotating shaft; and a hydraulic distribution unit for supplying hydraulic fluid to the cylinder, for reciprocation of the piston in the cylinder.

14. The attachment coupling device according to claim 1, wherein the actuator comprises:

a cylinder rotatably coupled to the coupler body via the drive support shaft;

a piston rotatably reciprocally movably coupled to the cylinder while being coupled to the movable hook by an actuator connecting pin spaced apart from the hook rotating shaft; and a hydraulic distribution unit for supplying hydraulic fluid to the cylinder, for reciprocation of the piston in the cylinder.

* * * * *